US007617566B2

(12) United States Patent
Chapman et al.

(10) Patent No.: US 7,617,566 B2
(45) Date of Patent: Nov. 17, 2009

(54) SYSTEM AND METHOD FOR PARTICLE COLLECTION

(75) Inventors: Martin D. Chapman, Charlottesville, VA (US); Matthew James Lombard, Staunton, VA (US); Amy Tsay, Palmyra, VA (US)

(73) Assignee: Indoor Biotechnologies, Inc., Charlottesville, VA (US)

( * ) Notice: Subject to any disclaimer, the term of this patent is extended or adjusted under 35 U.S.C. 154(b) by 364 days.

(21) Appl. No.: 11/672,103

(22) Filed: Feb. 7, 2007

(65) Prior Publication Data

US 2008/0184515 A1 Aug. 7, 2008

(51) Int. Cl.
*A47L 9/20* (2006.01)

(52) U.S. Cl. ..... 15/347; 15/344; 15/397; 285/7

(58) Field of Classification Search ..... 15/344, 15/347, 397; 285/7
See application file for complete search history.

(56) References Cited

U.S. PATENT DOCUMENTS

| | | | | |
|---|---|---|---|---|
| 4,279,095 | A * | 7/1981 | Aasen | 43/139 |
| 4,637,458 | A | 1/1987 | Hernandez | |
| 4,780,986 | A * | 11/1988 | Broomfield et al. | 43/139 |
| 4,997,209 | A | 3/1991 | McGrath et al. | |
| D388,914 | S | 1/1998 | McKnight | |
| 6,354,635 | B1 * | 3/2002 | Dyson et al. | 285/308 |
| 6,378,166 | B1 | 4/2002 | Bruno et al. | |
| 7,159,270 | B2 * | 1/2007 | Genoa et al. | 15/314 |
| 2005/0067833 | A1 | 3/2005 | Ball | |

* cited by examiner

*Primary Examiner*—Joseph J Hail, III
*Assistant Examiner*—Shantese McDonald
(74) *Attorney, Agent, or Firm*—Woods Rogers PLC; Peter E. Rosden

(57) ABSTRACT

A system for enabling the collection of dust and particle samples from a surface or sampling environment using an air suction device such as a vacuum cleaner. The system includes a nozzle incorporating a filter trap for collecting the particles as well as a reversible adapter enabling the connection of any one of a plurality of vacuum hoses having different diameters to the nozzle.

15 Claims, 8 Drawing Sheets

FIG. 5
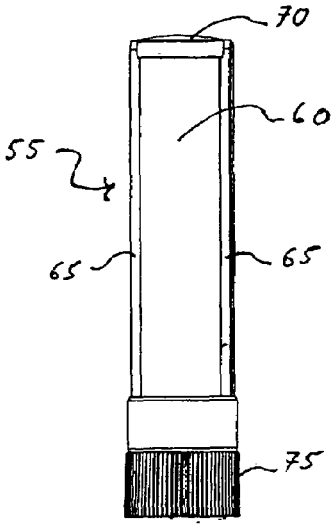
FIG. 6
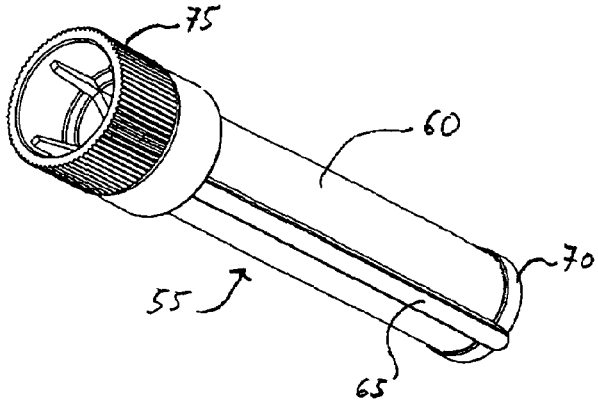
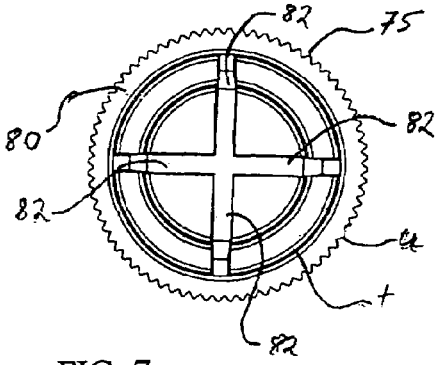
FIG. 7
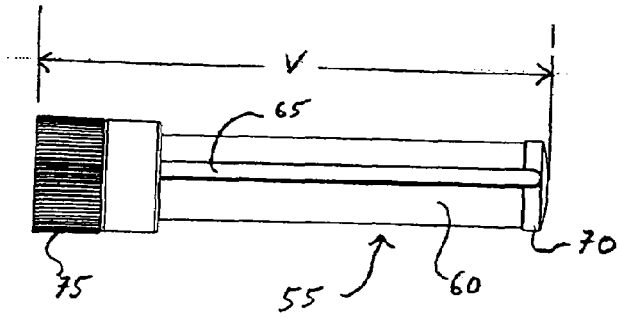
FIG. 8

FIG. 9
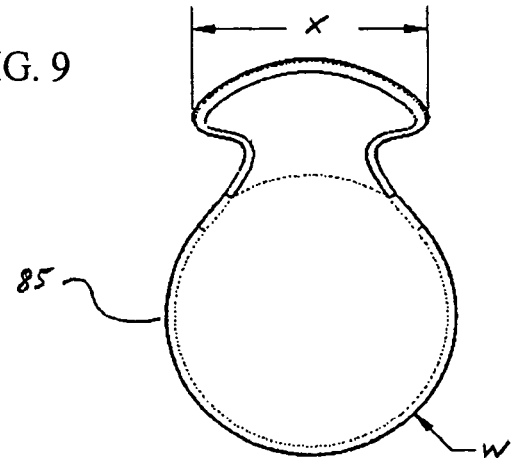
FIG. 12
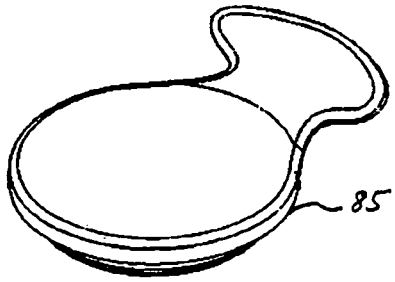
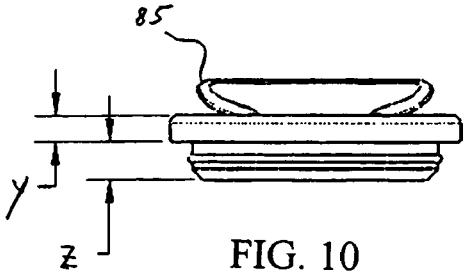
FIG. 10
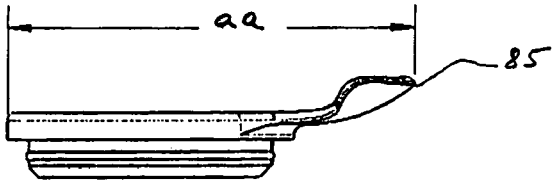
FIG. 11

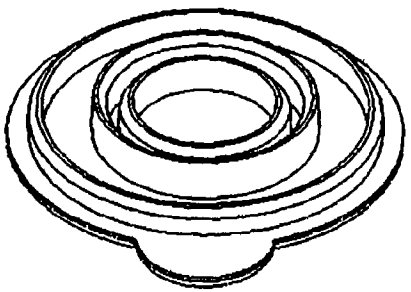
FIG. 15
FIG. 13
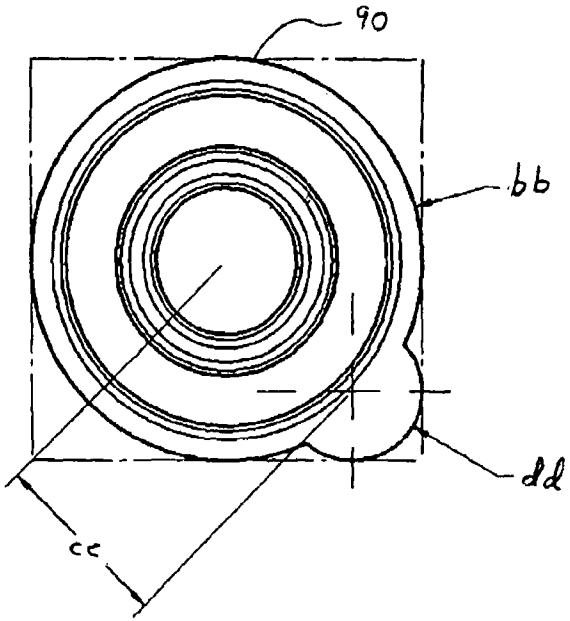
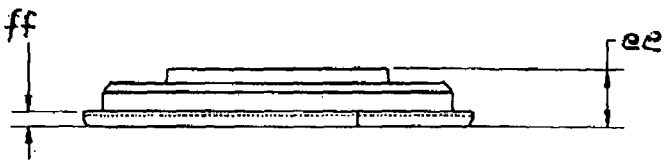
FIG. 14

SYSTEM AND METHOD FOR PARTICLE COLLECTION

TECHNICAL FIELD

The subject invention relates generally to a flexible, simple, economical system and method for interconnecting a dust collector with air suction devices. More particularly, this invention provides a dust collector apparatus which facilitates secure and easy attachment to a large variety of differently sized vacuum hoses.

BACKGROUND OF THE INVENTION

A heightened interest has developed amongst consumers and others in determining whether specified environments contain allergens such as dust mites, storage mites, cockroaches, animal dander, rodent urine, molds and endotoxin. Consumers have a particular interest in minimizing such substances in living and sleeping areas in order to control health conditions such as asthma and allergic reactions, while professionals are more concerned with the sterile nature of work environments.

Many individuals develop allergic reactions to one or more of the allergens listed above when found within their home. Household allergens can cause a variety of allergic symptoms such as sneezing, nasal congestion and a runny nose (perennial rhinitis), wheezing, breathlessness and mild, moderate or severe asthma. In some cases, exposure to indoor allergens can also cause allergic skin disease also known as eczema (or atopic dermatitis). Overall, approximately 20-30% of the population is allergic to one or more indoor allergens. Approximately 80% of children with asthma or nasal symptoms are allergic to indoor allergens. Asthma due to indoor allergens is an important clinical problem. Asthma accounts for approximately 1 out of every 7 visits of children to hospital emergency rooms. Some children may grow out of asthma by adolescence but in others the condition persists into adulthood.

With outdoor pollen allergens, the symptoms go away after the pollen season, but in the case of household allergens, patients are continuously exposed year round. This results in persistent inflammation of the nose or lungs. This kind of inflammation is caused by other chemicals (called leukotrienes) and includes other cells (called eosinophils). Once inflamed, the lungs become supersensitive (or hyperreactive) and can react to other substances. This is the reason why asthma attacks can be triggered by virus infection, tobacco smoke, chemicals, stress or exercise. Becoming allergic to household allergens is one of the first steps in developing asthma. Once asthma develops the symptoms can be triggered by infection, other substances in the environment, and physical activity.

One type of triggering allergen is the dust mite. House dust mites are 8 legged microscopic creatures that are closely related to spiders and ticks. Dust mites are about ⅓ of a millimeter long. They are barely visible to the naked eye but can be seen with a low power microscope. House dust mites are designed to live with humans. They feed mainly on human skin scales but can also feed on animal skin scales and debris found in dust. Humans shed approximately 5 grams of skin scales per week, which is enough to feed many thousands of mites. Mites thrive at temperatures of 70-72° F. and a relatively humidity of 75%. These warm, humid conditions are exactly the same as those favored by most humans. Large populations of mites are found in beds, pillows, bedding (blankets, comforters etc.) and bedroom carpets. Furry and other soft toys are also good homes for house dust mites. Fitted carpets and soft furnishings (sofas and chairs) are other common sites of mite infestation. Mites burrow down into carpet pile and into padded furniture. Carpets fitted onto concrete slabs in basements often become damp and harbor large numbers of mites.

To assess the level of mite infestation, acarologists measure mites present in a house dust sample. Such a measurement can either be made by counting mites or other allergens per gram of dust or by measuring specific mite, cat, dog, cockroach or fungal allergens in dust samples through an enzyme-linked immunosorbent assay (ELISA). In the case of mites, a low level is less than 20 mites per gram of dust. Allergies develop when people are exposed to approximate 100 mites per gram (or more). Heavy mite infestation is greater than 500 mites per gram dust. Allergic individuals are likely to have symptoms if they are continually exposed to dust containing more than 500 mites/g. Some highly sensitive patients may have symptoms when exposed to dust with lower mite counts. An ELISA test can be configured to visually indicate when specific levels of allergens are present in a sample.

The traditional method for assessing exposure to dust mites and other household allergens has been through collection and analysis of a dust sample taken from a test site. The typical way to collect such a sample has been to attach a suction device to a nozzle containing a filter trap so as to draw air from the test site into the nozzle and, hence, through the filter. The resulting collected dust sample can then be tested to determine the dust mite per gram. The problem with this method is its inflexibility. It typically requires use of a suction device dedicated for use with the nozzle or, at best, permits very limited use of alternative sources of suction such as vacuum cleaners simply because of the narrow range of hose connection sizes accommodated by the nozzle. This restricts the direct access of consumers to use of such test devices and thereby may often result in no such tests being performed where they should be or in the necessity to hire an outside service provider at a relatively substantial cost to come to the home to collect the necessary dust sample. There are adapter tubes and extension kits usable for vacuum cleaner hoses which accept hoses of several dimensions. However, these adapters and extension kits are clumsy to use due to their length and size and, in addition, can accommodate only a relatively small number of different hose diameters. Furthermore, these alternative devices do not lend themselves to compact packaging and mailing requirements. In addition, long tubes are not suitable either for insertion and extraction in situ of the small filter traps used to collect dust or for sealing to conduct in situ tests with a small volume of liquid. What is needed is an inexpensive, compact structure which is adaptable for use with a large variety of consumer and/or commercial vacuum cleaners having different hose diameters.

SUMMARY OF THE INVENTION

The present invention relates to a system and method for collecting and retaining particles contained in air drawn from a sampling surface or site by means of an air suction device such as a vacuum cleaner. The system is comprised of three primary elements. The first element is a hollow nozzle with an angled protruding tip, a base and a hollow cylinder reposing in the center thereof. The second element is a filter trap which may be inserted into and retained within the hollow cylinder but is also removable therefrom. The third element is a hollow, reversible adapter which may be interposed between the hollow nozzle and the hose of an air suction device. The adapter provides two rings on each section thereof onto which a variety of different air suction device hoses may be retainably attached. Each of the four rings has a different diameter enabling a variety of differently sized hoses to be attached first to the adapter. The adapter may be attached from either side to the hollow nozzle.

BRIEF DESCRIPTION OF THE DRAWINGS

The foregoing and other objects, aspects and advantages of the invention will be better understood from the following detailed description of the invention with reference to the drawings, in which

FIG. 5 is a plan view of a filter trap.

FIG. 6 is a perspective view of a filter trap.

FIG. 7 is a top end plan view of a filter trap.

FIG. 8 is a further plan view of a filter trap.

FIG. 9 is an overhead plan view of a small cap for sealing a nozzle.

FIG. 10 is a front edge plan view of a small cap for sealing a nozzle.

FIG. 11 is a side edge plan view of a small cap for sealing a nozzle.

FIG. 12 is a perspective view of a small cap for sealing a nozzle.

FIG. 13 is an overhead plan view of a large cap for sealing a nozzle.

FIG. 14 is a side edge plan view of a large cap for sealing a nozzle.

FIG. 15 is a perspective view of a large cap for sealing a nozzle.

DETAILED DESCRIPTION OF THE PREFERRED EMBODIMENT

Figure 1:
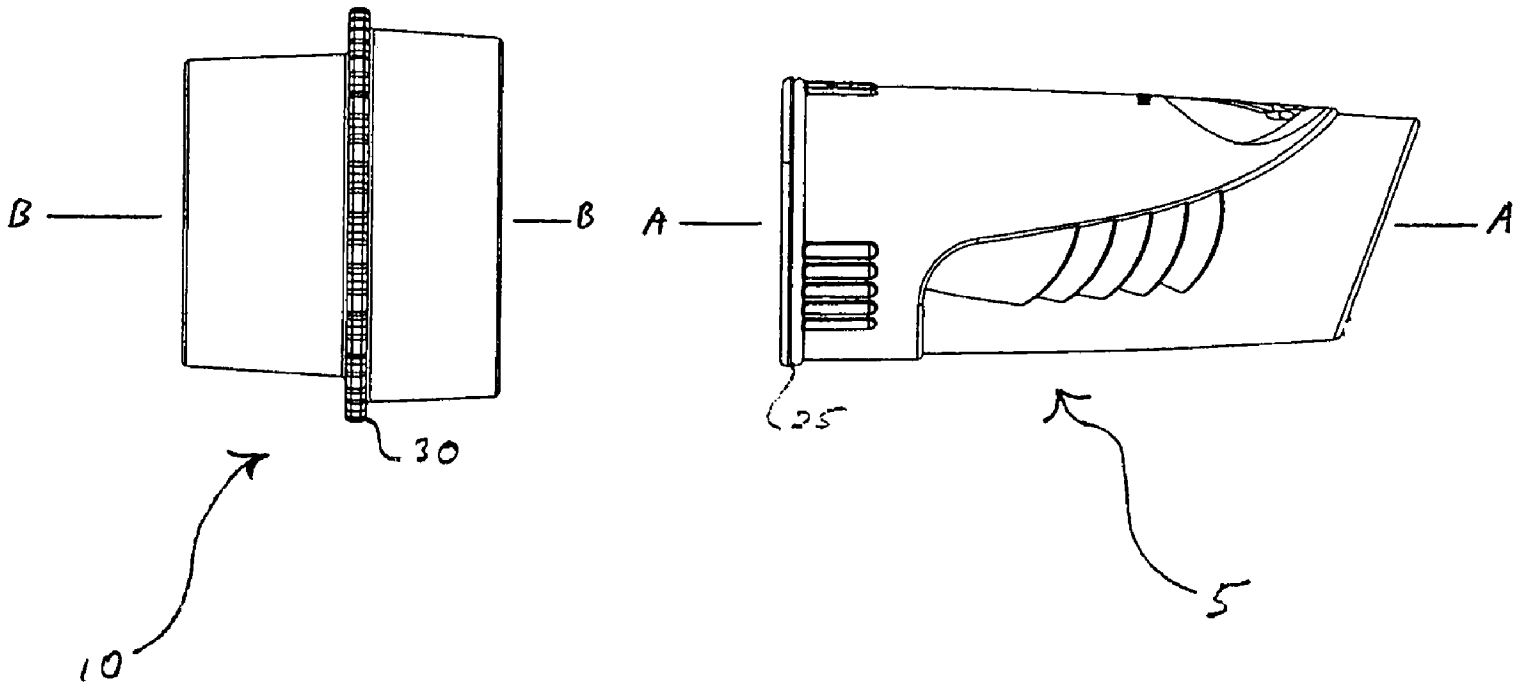
FIG. 1 is a plan view of the sides of the nozzle and adapter elements of the system of the invention.

The system of this invention includes a hollow dust collection nozzle, a reversible adapter for interconnection between the nozzle and a suction hose, a filter trap for insertion into the nozzle and a pair of caps to seal the nozzle. FIG. 1 presents a plan view of the sides of dust collector nozzle 5 and reversible adapter 10 detached from each other. These elements may be made from a plastic material such as polyethylene or polypropylene with a filler such as talc and must be rigid enough to withstand compression or expansion forces from being forced onto or into the end of a vacuum hose. It is preferable if there is some galling between materials to increase friction. All elements may be made through injection molding or any other suitable process. The lines showing on the external surface of nozzle 5 are both decorative and serve the function of providing a gripping surface for the hand so that a user can twist and disconnect nozzle 5 from either a vacuum hose or adapter 10, as explained below. Nozzle 5 and adapter 10 may be made transparent, translucent or colored, as desired, although an opaque appearance is preferable since the elements of the system will become dirty through the dust collection process.

Figure 2:
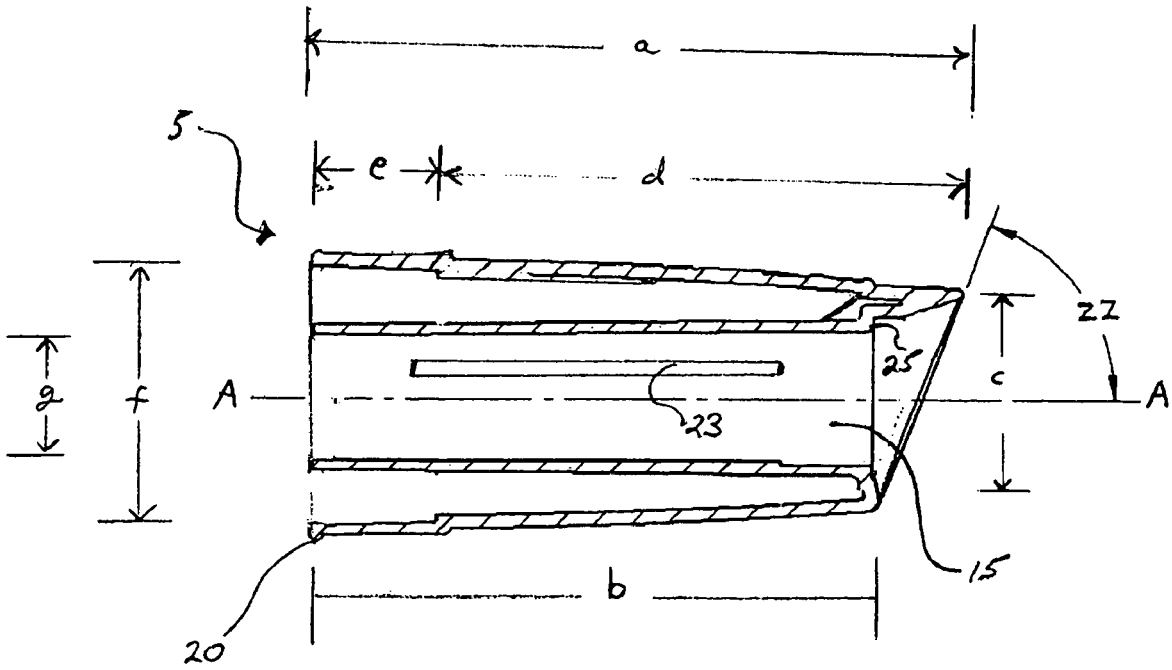
FIG. 2 is a cross-sectional view of a nozzle along line A-A of FIG. 1

A cross-sectional view of the preferred embodiment of nozzle 5 along line A-A is shown in FIG. 2. The maximum length a of nozzle 5 from protruding tip to base is approximately 3.05 inches, while the minimum length b of nozzle 5 from non-protruding tip to base is approximately 2.69 inches. Neither of these dimensions is critical to functioning of the system of the invention and may be varied so long as the angle zz formed across the tip of nozzle 5, which in the preferred embodiment is 70 degrees, remains preferably between 65 and 75 degrees. This angle is useful since, as described below, it facilitates the collection of samples by a user. The elliptical opening at the tip of nozzle 5 extends a distance c, which in the preferred embodiment is 0.976 inches. The body of the front portion of nozzle 5 forms an elliptical-type shape. This shape is an improvement over a rectangular or star shape in that it enables the transition from the round end, concentrates the vacuum into a central area, and offers improved flow characteristics over shapes with sharp corners. It also helps to reduce dragging or snagging which might otherwise occur when moved over fabrics. This shape tapers gradually outward on both the x axis and y axis for a distance d of approximately 2.69" away from the protruding tip of nozzle 5 which allows a manufacturable draft angle over that length. Then, for a distance e, of approximately 0.6 inches the body of nozzle 5 becomes circular, having an interior diameter f of approximately 1.252 inches. Furthermore this circular area has an inward taper towards the tip of nozzle 5 of approximately 2 degrees which is required for manufacturing and fit purposes. This circular area must permit nozzle 5 either to interconnect on both sides of adapter 10, as described below or to serve to interconnect to appropriately sized vacuum hoses by friction fitting either against its interior or exterior wall when adapter 10 is not used, as further described below. A hollow cylinder 15 open on both ends and having a diameter g of approximately 0.65 inches is formed in the interior of nozzle 5. This cylinder is a receptacle for a filter trap to collect dust as air flows therethrough, as described below. The diameter g is selected to enable insertion and retention of a filter trap. A small approximately semi-circular protrusion 20 is formed on the external wall of the base of nozzle 5 and enables nozzle 5 to interconnect with an interior wall of adapter 10, as described below. Cylinder 15 also includes at least three stops 23 which extends approximately 2.116 inches along the interior wall of cylinder 15 and protrude approximately 2.116 away from the interior wall of cylinder 15. These stops serve two functions, as described below, in relation to the filter trap of the system. Ledge 25 may be further formed where cylinder 15 ends within the tip of nozzle 5.

Figure 3:
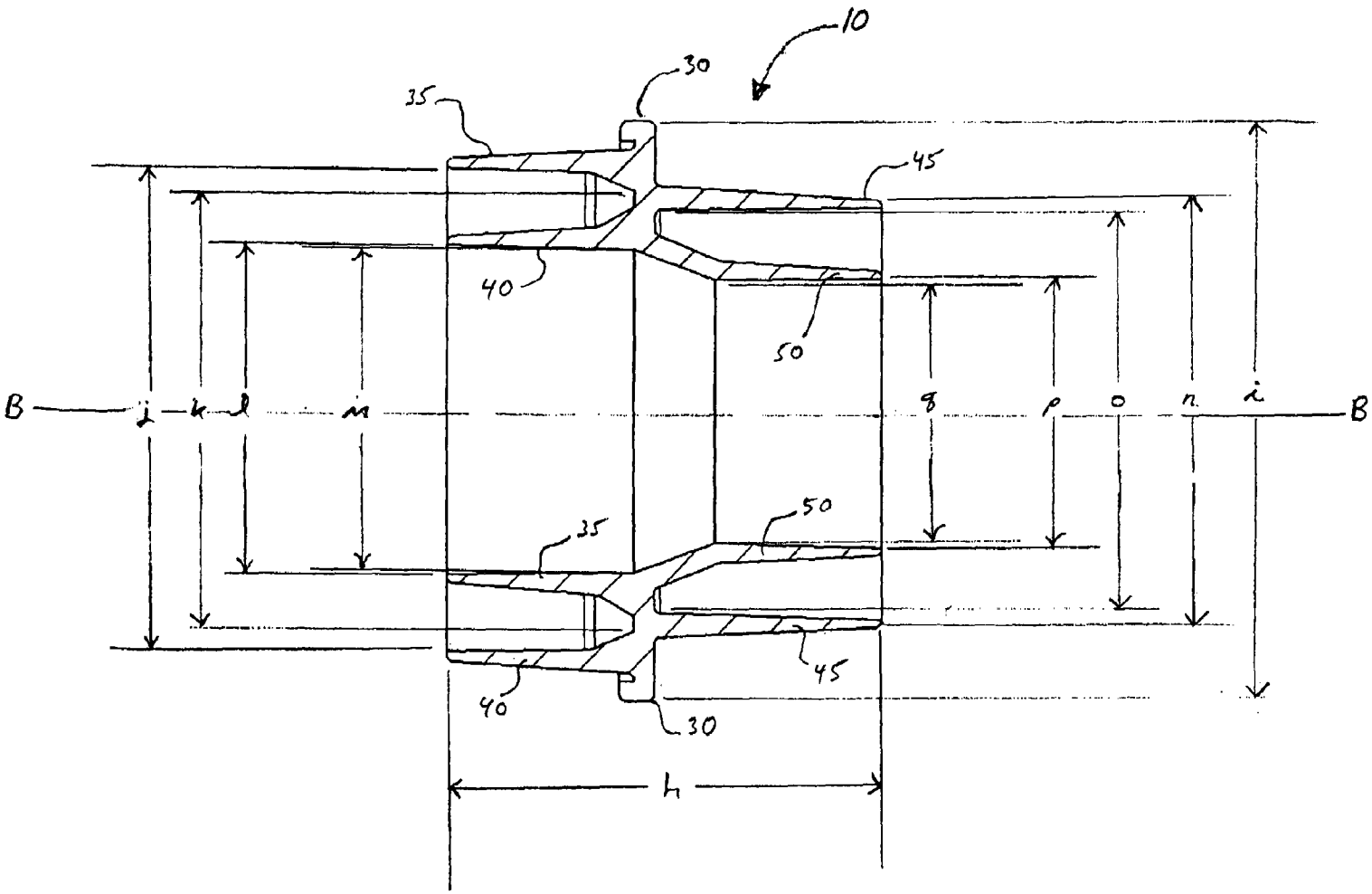
FIG. 3 is a cross-sectional view of an adapter along line B-B of FIG. 1.
Figure 4:
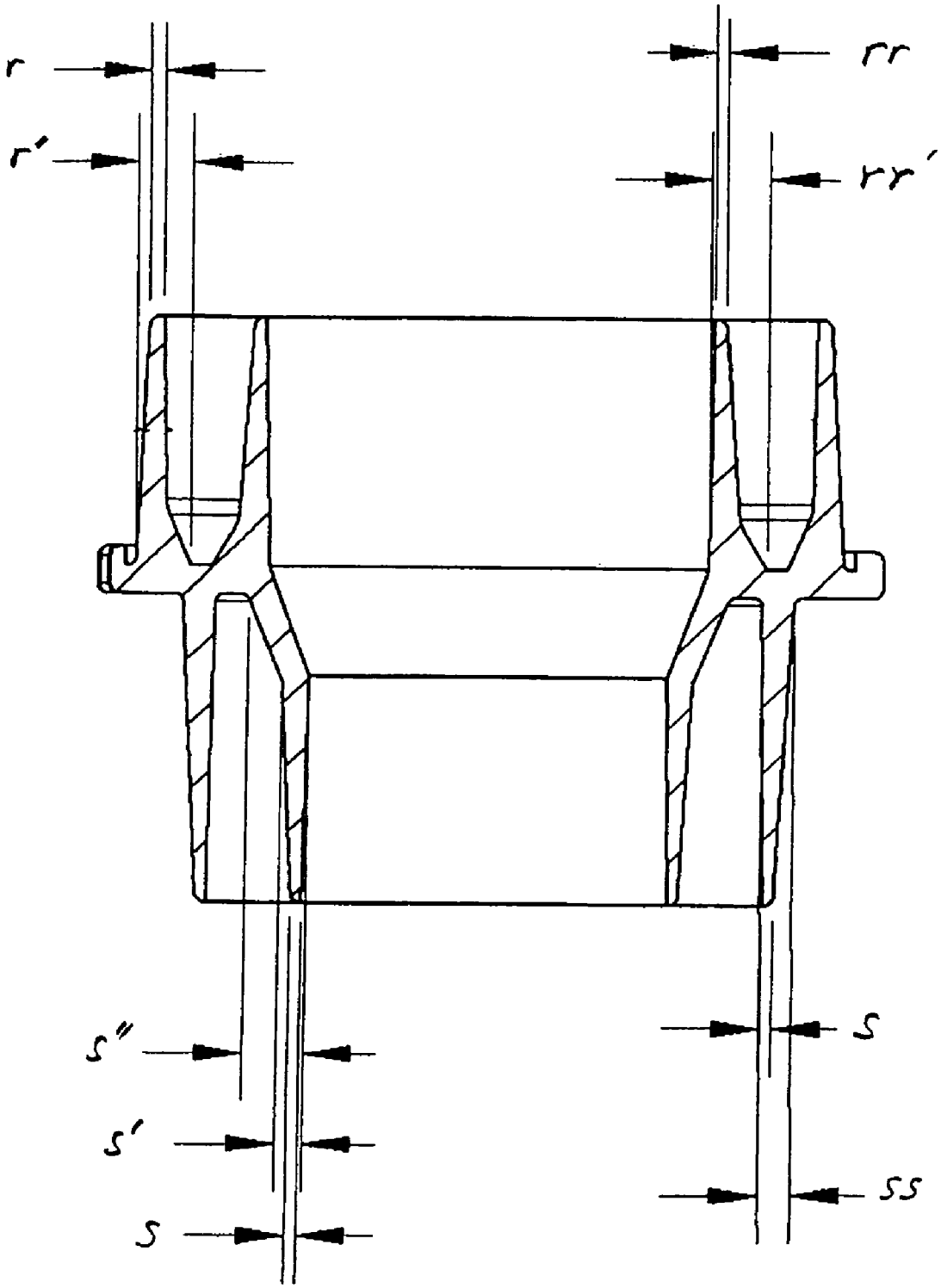
FIG. 4 is a cross-sectional view of an adapter along line B-B of FIG. 1.

A cross-sectional view of the preferred embodiment of adapter 10 along line B-B is shown in FIG. 3. Adapter 10 has an overall width h of approximately 1.520 inches. This dimension, as well as all others set out below, may increase or decrease by a manufacturing tolerance which is typically approximately +/−0.005 inches. Adapter 10 is divided by gripping ring 30, which in the preferred embodiment has a softly serrated edge and a diameter i of approximately 1.994 inches which can vary from +0.1 inch to −0.02 inch, into a larger diameter section and a smaller diameter section. The larger diameter section is comprised of a first outer ring 35 and a first inner ring 40. First outer ring 35 has an interior diameter j at its terminal end of approximately 1.668 inches and a starting diameter k where it is stopped at gripping ring 30 of approximately 1.525 inches. First inner ring 40 has an interior diameter l at its terminal end of approximately 1.155 inches and a starting diameter m, where it is stopped at gripping ring 30, of approximately 1.132 inches. Consequently, the inner walls of both first outer ring 35 and first inner ring 40 incorporate an inward taper from their terminal ends inwardly towards gripping ring 30. The exterior walls of both first outer ring 35 and first inner ring 40 incorporate a gentle outward taper of between approximately 1 and 4 degrees per side as measured from line B-B from their terminal ends inward towards gripping ring 30. The smaller diameter section is comprised of a second outer ring 45 and a second inner ring 50. Second outer ring 45 has an interior diameter n at its terminal end of approximately 1.428 inches and a starting diameter o where it is stopped at gripping ring 30 of approximately 1.361 inches. Second inner ring 50 has an interior diameter p at its terminal end of approximately 0.948 inches and a starting diameter q where it is stopped at gripping ring 30 of approximately 0.927 inches. Consequently, the inner walls of both second outer ring 45 and second inner ring 50 incorporate a very gentle inward taper from their terminal ends inwardly towards gripping ring 30. The exterior walls of both second outer ring 45 and second inner ring 50 further incorporate a gentle outward taper of between 1 and 4 degrees per side as measured from line B-B from their terminal ends inward towards gripping ring 30. However, at a distance of approximately 0.589 inches from its terminal end, the angle formed between the inner walls of second inner ring 50 and line B-B increases to approximately 20 degrees as measured from line B-B until second inner ring 50 terminates at gripping ring 30. At that same point, the angle formed between the exterior walls of inner ring 50 and line B-B increases to approximately 21 degrees as measured from line B-B until second inner ring 50 terminates at gripping ring 30. The tapered structures incorporated into both the larger diameter section and the smaller diameter section of adapter 10 serve to provide increasing friction on vacuum hoses as they are inserted, as described below, over or under the respective outer or inner rings thereby providing a much wider fitting flexibility than heretofore available. FIG. 4 provides a further cross-sectional view of the preferred embodiment of adapter 10 along line B-B as shown in FIG. 3 for purposes of displaying additional dimensions of adapter 10. The thickness r of first outer ring 35 is approximately 0.035 inches at its terminal end, while the thickness r' of first outer ring 35 is approximately 0.139 inches adjacent to gripping ring 30. The thickness rr of first inner ring 40 is approximately 0.030 inches at its terminal end, while the thickness rr' of first inner ring 40 is approximately 0.145 inches adjacent to gripping ring 30. The thickness s of both second outer ring 45 and second inner ring 50 is approximately 0.027 inches at their terminal ends. The thickness s' of second inner ring 50 at a point where it changes from a one degree taper to a 4 degree taper is approximately 0.068 inches while the thickness s" of second inner ring 50 is approximately 0.151 inches adjacent to gripping ring 30. The thickness ss of second outer ring 45 is approximately 0.081 inches adjacent to gripping ring 30.

The dust collection system further comprises a filter trap 55 which is shown in FIGS. 5, 6, 7 and 8. As shown in FIGS. 5 and 6, filter trap 55 includes a nylon filter 60 designed to capture particles having a maximum dimension of 40 microns or more. Filter 60 is attached to a plastic cylindrical structure comprised of two vertical side supports 65, each of which is attached on one end to a bottom closing cap 70 and on the other end to an open-ended cylindrical top support 75. FIG. 7 shows that top support 75 includes a plurality of ridges around its outer circumference to facilitate gripping. Top support 75 has an interior diameter t of approximately 0.504 inches and an exterior diameter u of approximately 0.630 inches. The difference of 0.126 inches between these two diameters represents a plastic rim 80 formed on both the top and bottom of top support 75, the bottom of which, as explained below, interacts with protrusions within hollow cylinder 15 in nozzle 5 when filter trap 55 is inserted into hollow cylinder 15 prior to collecting samples to stop further downward movement of filter trap 55. Cross supports 82 give strength to filter trap 55. FIG. 8 shows a side view of filter trap 55 indicating its length v of approximately 2.421 inches.

The dust collection system further comprises a small cap 85 and a large cap 90, each of which include grasping tabs. Small cap 85 snaps in place into the end of cylinder 15 nearest the tip of nozzle 5 and is designed to provide a water tight fit at that location. FIGS. 9, 10 and 11 provide plan views from overhead, front edge and side edge positions, respectively, of small cap 85. The diameter w of the central portion of small cap 85 is 0.75 inches, while the width x of the tab is 0.61 inches as shown in FIG. 9. The thickness y of the widest portion of small cap 85 is 0.07 inches while the sealing stopper portion of small cap 85 extends downward a distance z of 0.10 inches as shown in FIG. 10. The overall width aa of small cap 85 is 1.06 inches as shown in FIG. 11. FIG. 12 provides a perspective view of small cap 85. These dimensions can be varied, as can the design of small cap 85, so long as the small cap includes a sealing stopper portion which provides a watertight seal within cylinder 15. Large cap 90 snaps in place into the end of cylinder 15 furthest away from the tip of nozzle 5 and is designed to provide a water tight fit at that location. FIGS. 13 and 14 provide plan views from overhead and side edge positions, respectively, of large cap 90. As shown in FIG. 13, the outside diameter bb of large cap 90 is 1.40 inches, while the diameter cc of the snap-on portion of large cap 90 is 0.642 inches. The tab portion of large cap 90 has a radius dd of 0.246 inches and is designed to fit inside a square having dimensions matching outside diameter bb. Such a square is indicated surrounding large cap 90 in FIG. 13. As indicated in FIG. 14, the maximum thickness ee of large cap 90 is 0.20 inches, while the widest portion of large cap 90 has a total thickness ff of 0.20 inches. FIG. 15 presents a perspective view of the bottom of large cap 90.

Figure 16:
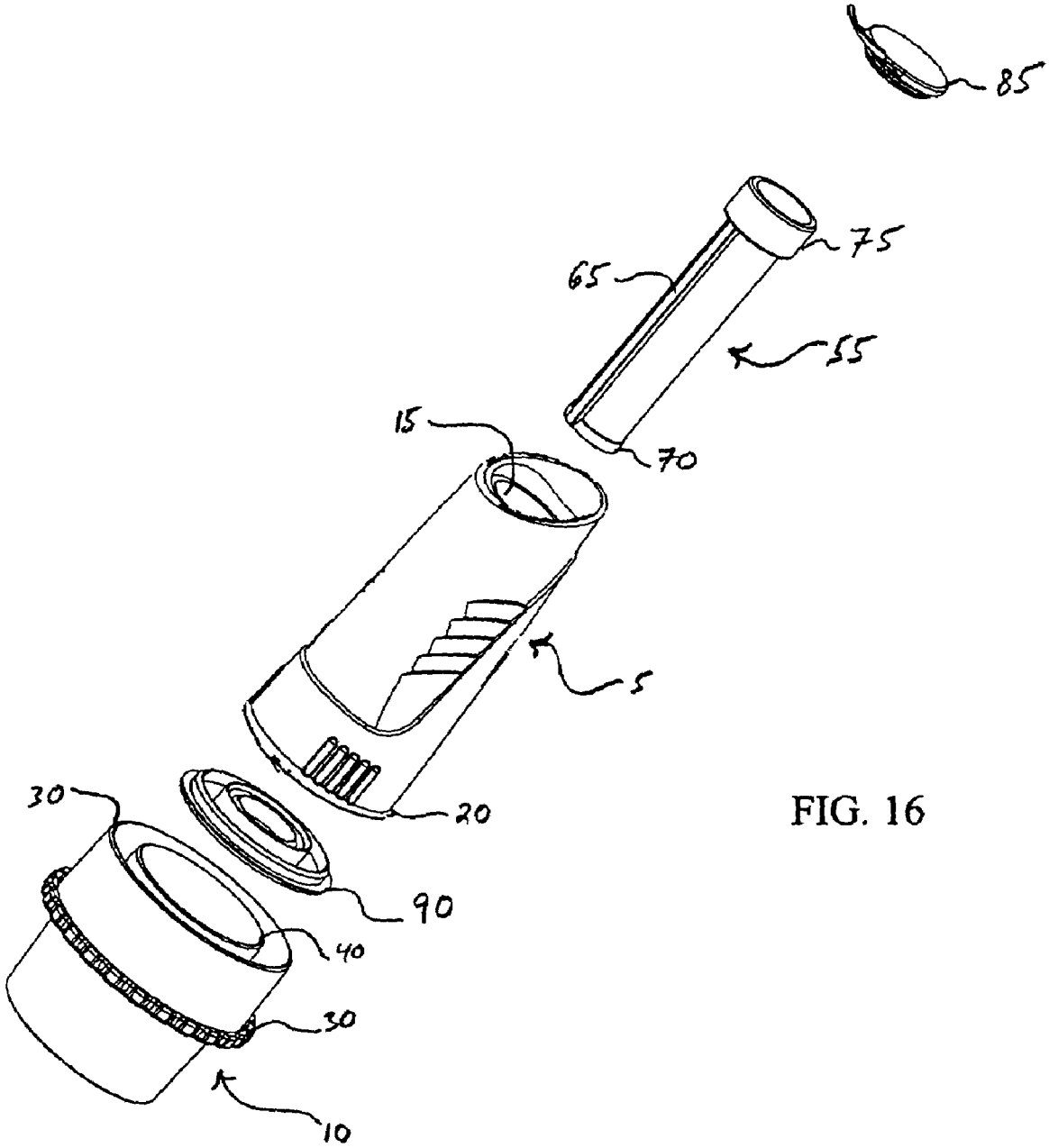
FIG. 16 is a perspective view of elements of the system in a disassembled state.

Turning now to the method of using the system of the invention, reference is made to FIG. 16 which is a perspective view of all of the elements of the system in a disassembled state which may be separately packaged and delivered to a customer prior to assembly and use or may be delivered partially assembled. In order to assemble the collection system of this invention, large cap 85 and small cap 90, if they arrive already attached to the tip and base of nozzle 5, are removed therefrom. Filter trap 55 is inserted, bottom closing cap 70 first, into cylinder 15 and pushed downward against friction caused by stops 23 until the ends of stops 23 prevent plastic rim 80 from being moved further into cylinder 15. At this point filter trap 55 is properly positioned within cylinder 15 and is retained in position due to the friction exerted by stops 23 against supports 65 and the side of bottom cap 70. The user then visually compares the diameter of the vacuum hose from his or her vacuum cleaner or suction device with the diameters of the rings formed at the termination of cylinder 15 and circular portion of nozzle 5 extending over the distance e at the base of nozzle 5. If the hose appears to be close to either of these diameters, the user inserts the hose either inside of or around the outside the appropriate one of these circular openings. If these rings do not appear to match the hose diameter, the user then further compares the hose diameter with that of first outer ring 35 and first inner ring 40 on the larger diameter section of adapter 10. If no similarity is found, yet another comparison is made between the hose diameter and that of second outer ring 45 and second inner ring 50 on the smaller diameter section of adapter 10. Only an approximate match to the hose diameter need be found since the tapering of the various ring walls, described above, enables each ring to provide an interior or exterior friction fit to a large range of hoses. If use of adapter 10 is necessary, nozzle 5 can be attached to either side of adapter 10, making the adapter fully reversible. If attachment to the smaller diameter section of adapter 10 is required, a slight recess is provided at the base on the interior wall of second outer ring 45 into which semi-circular protrusion 20 can be snap-fitted by exerting mild downward pressure on nozzle 5. If attachment to the larger diameter section of adapter 10 is required, the diameter of first inner ring 40 is such that the exterior nozzle wall can make a friction fitting when placed over the outer wall of first inner ring 40. In either case, the vacuum hose can then be friction-fitted to the appropriate ring on the exposed side of adapter 10. Experimentation has shown that by using one of the rings provided by the system of this invention 100% of the vacuum hoses of 60 different commercially available vacuum cleaners with round hose fittings tested could be successfully and retentively connected to nozzle 5 throughout a dust collection sequence. Table 1 below sets forth the range of diameter of hose which each ring available through the system of this invention will fit.

TABLE 1

| | used as male | used as female |
|---|---|---|
| small end, small diameter | 1.002-1.060 | 0.927-0.948 |
| small end large diameter | 1.482-1.562 | 1.401-1.428 |
| large end small diameter | 1.214-1.423 | 1.132-1.155 |
| large end large diameter | 1.738-1.803 | 1.525-1.668 |

A dust sample is collected in approximately two minutes by turning on a vacuum cleaner attached to a properly assembled and connected nozzle 5 and, then, running nozzle 5 over preferable four test areas, such as carpet or bedding, each of which is approximately the size of letter size paper. Each area should be sampled for approximately 30 seconds. Due to the angle zz formed at the tip of nozzle 5, the user may much more easily move the nozzle across the sample surfaces while maintaining contact with those surfaces. If angle zz were 90 degrees, although possible, handling nozzle 5 would become much more awkward and uncomfortable for the user. Alternatively, nozzle 5 could simply be exposed to an environment believed to contain particles of material from which a sample is desired. Typically, the result after sampling is completed will be a pile of dust collected in filter trap 55. The system user then has two options. First, nozzle 5 can be detached and immediately closed by snapping small cap 85 onto the tip of nozzle 5 and large cap 90 onto the base of nozzle 5 thereby sealing in the dust sample during transport. Then, nozzle 5 can be shipped to a testing laboratory for analysis. Alternatively, the system user can conduct an analysis in situ by placing large cap 90 onto the base of nozzle 5 and adding a buffered saline solution to cylinder 15. After closing nozzle 5 by snapping small cap 85 into place, the dust is solubilized by shaking. A pipette or other device which may be optionally supplied with the system can then be used to withdraw a sample of the solubilized dust from cylinder 15 and apply it to an optional sampler containing an antigen which reacts visibly with specific substances.

Although the above disclosure has described use of this invention in a household environment concentrating on house mites, similar collection techniques can be used for forensic purposes and to assess exposure to other allergens and to a wide variety of biologics suitable for immunoassay or chemical or DNA testing including food and pollen allergens found in collected dust. Furthermore, testing can be expanded beyond homes to include schools, commercial buildings and workplaces and used for lead sampling and chemical environmental measurements.

Although various elements in the previously described embodiments of this invention have been disclosed with reference to particular types of materials and particular sequences of steps, it should be understood that the functions performed by these materials may also be performed in appropriate cases by other types of materials and that this invention is not limited by reference to the specific materials disclosed. Furthermore, the process steps disclosed are not the only way in which the function of this invention can be implemented. Other embodiments and sequences of steps are possible so long as the functions and advantages described above are preserved.

What is claimed is:

1. An allergen collection system for enabling the rapid collection within no more than two minutes of a testable sample of dust particles, retention of that sample, and in situ testing thereof by drawing air through the system using any one of a large variety of air suction devices each having a round hose with a different diameter connected thereto comprising:

a hollow nozzle having an angled protruding tip for placement in contact with a surface or exposure to an environment from which particles are to be collected, an opposing round base and a hollow cylinder of uniform diameter formed along the center axis thereof and extending approximately from the bottom of the tip to the base;

filter trap means removably and retainably insertable into the hollow cylinder within said hollow nozzle for collecting and retaining the particles;

hollow adapter means retainably and reversibly connectable to the base of said hollow nozzle for interconnecting the base of said hollow nozzle to any one of a plurality of round hoses having different diameters attached to one of the air suction devices;

sealing means for placement on both ends of said hollow nozzle so as to produce a watertight seal when inserted into place;

solubilizing means for liquefying the collected dust particles while they are retained in said hollow adapter means;

withdrawal means for removing some of the liquefied collected particles from said hollow adapter means; and a testing sampler containing an antigen chosen to react visibly with specific substances.

2. The system of claim 1 wherein said sealing means comprises a first cap to seal the tip of said hollow nozzle and a second cap to seal the base of said hollow nozzle.

3. The system of claim 1 wherein the protruding tip of said hollow nozzle has an elliptical shape and forms a maximum angle of between 65 and 75 degrees with the horizontal central axis of said hollow nozzle.

4. The system of claim 1 wherein an approximately semi-circular protrusion is formed around the external wall of the base of said hollow nozzle.

5. The system of claim 4 wherein the inner wall of the second outer ring has a notch formed therein at the bottom thereof adjacent to the gripping ring.

6. The system of claim 1 wherein the first diameter is approximately 1.668 inches, the second diameter is approximately 1.155 inches, the third diameter is approximately 1.428 inches and the fourth diameter is approximately 0.948 inches.

7. The system of claim 1 wherein said filter trap means is further comprised of a nylon filter attached to a plastic cylindrical structure having two vertical side supports, each of which is attached on one end to a bottom closing cap and on the other end to an open-ended, hollow, cylindrical top support.

8. The system of claim 7 wherein the top support has an interior diameter of approximately 0.504 inches and an exterior diameter of approximately 0.630 inches.

9. The system of claim 1 wherein said hollow nozzle and said hollow adapter means are made with polyethylene or polypropylene incorporating a filler material, and each is rigid enough to withstand compression or expansion forces resulting from being forced onto or into the end of a vacuum hose.

10. The system of claim 1 wherein said adapter means has on a large section thereof a round first outer ring with a first diameter at its terminal end and a round first interior ring with a smaller second diameter at its terminal end and on an opposing small section thereof a round second outer ring with a third diameter at its terminal end less than the first diameter but greater than the second diameter and a round second interior ring with a fourth diameter at its terminal end less than the second diameter, the large section and the small section thereof being separated by an external gripping ring.

11. The system of claim 1 wherein said solubilizing means is a buffered saline solution.

12. The system of claim 1 wherein said withdrawal means is a pipette.

13. An allergen collection system for enabling the rapid collection within no more than two minutes of a testable sample of dust particles and retention of that sample in a shippable form for off site testing by drawing air through the system using any one of a large variety of air suction devices each having a round hose with a different diameter connected thereto comprising:

a hollow nozzle having an angled protruding tip for placement in contact with a surface or exposure to an environment from which particles are to be collected, an opposing round base and a hollow cylinder of uniform diameter formed along the center axis thereof and extending approximately from the bottom of the tip to the base;

filter trap means removably and retainably insertable into the hollow cylinder within said hollow nozzle for collecting and retaining the particles;

hollow adapter means retainably and reversibly connectable to the base of said hollow nozzle for interconnecting the base of said hollow nozzle to any one of a plurality of round hoses having different diameters attached to one of the air suction devices; and sealing means for placement on both ends of said hollow nozzle so as to produce a watertight seal when inserted into place.

14. A system for enabling the collection and retention of particles of material by drawing air through the system using any one of a large variety of air suction devices each having a round hose with a different diameter connected thereto comprising:

a hollow nozzle having an angled protruding tip for placement in contact with a surface or exposure to an environment from which particles are to be collected, an opposing round base and a hollow cylinder of uniform diameter formed along the center axis thereof and extending approximately from the bottom of the tip to the base wherein an approximately semi-circular protrusion is formed around the external wall of the base of said hollow nozzle;

first cap means for sealing the tip of said hollow nozzle;

second cap means for sealing the base of said hollow nozzle;

filter trap means removably and retainably insertable into the hollow cylinder within said hollow nozzle for collecting and retaining the particles wherein said filter trap means is comprised of a nylon filter attached to a plastic cylindrical structure having two vertical side supports, each of which is attached on one end to a bottom closing cap and on the other end to an open-ended, hollow, cylindrical top support, said filter trap having an interior diameter of approximately 0.504 inches and an exterior diameter of approximately 0.630 inches; and hollow adapter means retainably and reversibly connectable to the base of said hollow nozzle for interconnecting the base of said hollow nozzle to any one of a plurality of round hoses having different diameters attached to one of the air suction devices, said adapter means having on a large section thereof a round first outer ring with a first diameter at its terminal end and a round first interior ring with a smaller second diameter at its terminal end and on an opposing small section thereof a round second outer ring with a third diameter at its terminal end less than the first diameter but greater than the second diameter and a round second interior ring with a fourth diameter at its terminal end less than the second diameter, the large section and the small section thereof being separated by an external gripping ring wherein the inner wall of the second outer ring has a notch formed therein at the bottom thereof adjacent to the gripping ring.

15. The system of claim 14 with a reversible adapter for interconnecting objects having generally round connector sections with different diameters further comprising:

a large section having a round first outer ring with a first diameter at its terminal end and a round first interior ring with a smaller second diameter at its terminal end;

an opposing small section having a round second outer ring with a third diameter at its terminal end less than the first diameter but greater than the second diameter and a round second interior ring with a fourth diameter at its terminal end less than the second diameter; and an external gripping ring separating said large section from said small section.

* * * * *

UNITED STATES PATENT AND TRADEMARK OFFICE

CERTIFICATE OF CORRECTION

PATENT NO. : 7,617,566 B2
APPLICATION NO. : 11/672103
DATED : November 17, 2009
INVENTOR(S) : Chapman et al.

It is certified that error appears in the above-identified patent and that said Letters Patent is hereby corrected as shown below:

Column 1, after line 2, add the following text:

-- STATEMENT REGARDING FEDERALLY SPONSORED RESEARCH OR DEVELOPMENT

The United States government has a paid-up license in this invention and the right in limited circumstances to require the patent owner to license others on reasonable terms as provided by the terms of Contract No. HHSN21900555545C and Grant No. 5 R44 ES011920-03, awarded by the National Institute of Environmental Health Sciences. --

Signed and Sealed this

Fifth Day of January, 2010

David J. Kappos

David J. Kappos
*Director of the United States Patent and Trademark Office*